United States Patent [19]
Chauhan et al.
[11] 4,280,817
[45] Jul. 28, 1981

[54] SOLID FUEL PREPARATION METHOD

[75] Inventors: Satya P. Chauhan; Herman F. Feldmann; Edgel P. Stambaugh, all of Worthington, Ohio; Ke-Tien Liu, Allison Park, Pa.

[73] Assignee: Battelle Development Corporation, Columbus, Ohio

[21] Appl. No.: 162,979

[22] Filed: Jun. 25, 1980

Related U.S. Application Data

[63] Continuation of Ser. No. 949,981, Oct. 10, 1978, abandoned.

[51] Int. Cl.[3] ..... C10L 9/02
[52] U.S. Cl. ..... 44/1 R; 44/1 F; 201/17
[58] Field of Search ..... 44/1 SR, 1 R, 1 F; 201/17

[56] References Cited

U.S. PATENT DOCUMENTS

| | | | |
|---|---|---|---|
| 1,007,153 | 10/1911 | Spurrier | 44/1 SR |
| 3,640,016 | 2/1972 | Lee et al. | 44/1 SR |
| 4,092,125 | 5/1978 | Stambaugh et al. | 44/1 SR |

*Primary Examiner*—Carl F. Dees
*Attorney, Agent, or Firm*—Philip M. Dunson; C. Henry Peterson; Barry S. Bissell

[57] ABSTRACT

A process for treating solid particles (66) of a raw carbonaceous fuel (62) such as coal having an original sulfur content comprises producing (at 68) a slurry (74) of a quantity of the raw fuel particles and a liquid medium (70) comprising water, at least one alkali metal compound including a substantial amount of sodium or potassium sulfide or polysulfide or a combination thereof, and a catalytic agent (72) comprising calcium or magnesium oxide or carbonate, or dolomite. The slurry is subjected (in 78) for an effective period of time to elevated temperature and pressure effective with the alkali metal compounds and water to cause the medium to penetrate the microscopic structure of the particles and to chemically and physically incorporate a substantial amount of the catalytic agent into the structure. The readily separable medium is separated (at 84) from the fuel particles and the particles are washed (at 84,106) to produce a particulate fuel product (88,110) containing the incorporated catalytic agent. A substantial portion (90,94) of the separated medium is added (at 70) to the slurry produced as above. A sufficient quantity of the catalytic agent is added (at 72) to the medium or the slurry to replace the catalytic agent removed from the slurry with the particulate fuel product. More raw fuel particles (66) are added to the medium or the slurry. The foregoing steps are carried out continually with a multiplicity of new additions of the raw fuel particles and with a multiplicity of reuses of the separated medium to produce fuel product particles (88,110) containing a quantity of sulfur that is not less than the original sulfur content, in addition to the catalytic agent.

15 Claims, 8 Drawing Figures

SOLID FUEL PREPARATION METHOD

PRIOR APPLICATION

This is a continuation of U.S. Pat. application Ser. No. 949,981, filed Oct. 10, 1978, and now abandoned.

TECHNICAL FIELD

This invention relates to the processing of coal and like carbonaceous materials to produce feedstocks for gasification, combustion, and other uses. More particularly the invention relates to a process wherein particulate coal is physically and chemically altered and encatalyzed, typically with a calcium, magnesium, or dolomite catalyst, at an elevated temperature in an aqueous medium containing an alkali metal sulfide or polysulfide impregnant. The alteration of the coal does not include the removal of sulfur therefrom, but the catalyst incorporated into the coal acts as a sulfur absorber during gasification or combustion. The quantity, the distribution, and the form of the incorporated catalyst are such that an increased quantity of sulfur is captured in the eventual ash formed when the feedstock is used.

RELATED PATENTS AND APPLICATIONS

U.S. Pat. No. 4,055,400, Stambaugh and Sachsel, discloses a hydrothermal process for extracting sulfur compounds and ash from a solid carbonaceous fuel of the coal or coke type, by leaching it with an aqueous alkaline solution containing a sodium, calcium, or ammonium carbonate, hydroxide, sulfide, or hydrosulfide, or a plurality thereof, at temperatures above about 125° C. and pressures above about 25 psig, with subsequent separation of the easily removable leached out materials from the remainder of the fuel, and washing of the remainder of the fuel.

U.S. Pat. No. 4,092,125, Stambaugh and Chauhan, discloses a process employing an aqueous solution containing a mixture of (a) sodium, potassium, or lithium hydroxide, together with (b) calcium, magnesium, or barium hydroxide or carbonate, or a plurality thereof, in proper proportions and under proper temperature and pressure conditions, for treating coal or coke-type fuel particles so as to produce more highly reactive feedstocks adapted for use in gasification, combustion, pyrolysis, and/or liquefaction processes. The treatment process of this patent was found to be more effective in causing sulfur to be carried away with the solution when the solution was separated from the treated fuel particles. It was also found to be effective to lower the content of sodium, potassium, or lithium in the treated fuel particles when the particles were washed. Moreover, it was found to produce a highly pervasive encatalyzation of the fuel particles with a substantial quantity of both physically and chemically incorporated calcium, magnesium, or barium. This not only catalyzes the gasification (or other) reaction; but the incorporated calcium, magnesium, or barium also combines with sulfur remaining in the treated fuel particles so that an increased portion of the sulfur (originally present in the fuel) is captured in the eventual ash.

One preferred embodiment of the present invention is described but not claimed per se in the copending U.S. patent application Ser. No. 859,809, filed Dec. 12, 1977 now abandoned, by Herman F. Feldmann for "Integrated Process".

A related process utilizing sodium sulfide and calcium oxide is described in an abandoned application Ser. No. 602,258, filed Aug. 6, 1975, by Edgel P. Stambaugh, Herman F. Feldmann, and Satya P. Chauhan for "Pyrolyzing Coal".

The disclosures of the foregoing patents and applications are incorporated by reference herein.

BACKGROUND ART AND SYNOPSIS

When heated to the temperatures encountered in ordinary combustion, pyrolysis, and/or gasification processes, coal such as a typical eastern bituminous coal may exhibit one or more of the unfavorable reactions that include swelling, caking, agglomerating, and emission of sulfurous vapors.

Many proposals have been made for processes to remove sulfur from solid and liquid carbonaceous fuels before the fuels are burned or converted to other fuels or other products. Some of these proposals include the use of alkali metal sulfides. In the case of liquid materials, for example, U.S. Pat. No. 1,413,005, Cobb, discloses removing sulfur from petroleum oil with an alkaline earth sulfide compound prepared by mixing 800 pounds of freshly burned lime (CaO) with a mixture of 600 pounds of commercial sulfide of soda ($Na_2S$) in 417 pounds of water. The oil and the sulfide compound are agitated together, with steam, at 212° to 300° F. U.S. Pat. No. 2,020,661, Schulze, discloses removing sulfur from petroleum and hydrocarbon liquids with an aqueous solution of sodium monosulfide or polysulfides, using excess alkalinity provided by adding sodium hydroxide solution, at 40° to 90° F. Proposals of this kind deal with elemental sulfur and sulfur compounds already in the liquid form, such as liquid mercaptans.

Removal of sulfur from solid fuels is generally more difficult. Typically, U.S. Pat. No. 3,472,624, Ridley, discloses that coke can be desulfurized by reacting it with $Na_2S$, initially containing 4 percent water and hydrogen at 1,000° and 1,400° F. in a kiln, then washing with water. According to the patentee, a major advantage is that the $Na_2S$ can be recycled directly, without expensive conversion to $Na_2CO_3$ or NaOH. Such desulfurization reactions are carried out at temperatures higher than the critical temperature of water (ca 706° F.) so that they take place in a dry state. The temperatures employed are considerably above the thermal degradation temperatures for bituminous coals, for example, so valuable volatile constituents are lost rather than retained in the product feedstocks. At such high temperatures, moreover, some of the remaining constituents may be transformed into even less reactive compounds.

In contrast, the hydrothermal processes employ a distinctive form of treatment, as outlined above, that significantly upgrades the quality of raw particulate coal. The improved process of U.S. Pat. No. 4,092,125, Stambaugh and Chauhan, supra, is particularly effective for desulfurization of the coal and/or for increasing the chemical reactivity and improving the physical behavioral characteristics of the product feedstock.

Although the feedstocks produced by these last-mentioned processes are of outstanding quality, for some uses they may be prohibitively expensive; in particular where the required feedstock characteristics are such that the processes must include regeneration or frequent replacement of the aqueous treating solution.

The present invention provides a considerably less expensive process, yet retains most of the advantages of the improved hydrothermal processes, supra. The free-swelling index of the coal can be reduced substantially to unity, and the resulting feedstock can be rendered substantially non-caking and non-agglomerating under the conditions of its use in an ordinary gasifier, combustor, or liquefaction plant. It is understood that such terms as free-swelling index (FSI), non-agglomerating (NA) and the like are used as defined in ASTM Test No. D-720-67. FSI is a measure of the caking and agglomerating characteristics of the feedstock, since coals with high FSI values invariably cake and agglomerate, whereas FSI values near unity indicate that the feedstock will pass freely through a coal utilization process such as that employed in a gasifier. The improved characteristics of the feedstock produced by a process according to this invention, together with the highly pervasive encatalyzation of the feedstock with the calcium, magnesium, or dolomite produce a highly reactive feedstock. The catalyst incorporated in the coal acts as a sulfur absorber during gasification or combustion.

While the process of the present invention is not designed to remove sulfur from the coal during the process of converting it to a feedstock, the pervasive presence in the feedstock of a considerable quantity of calcium and/or magnesium causes an increased quantity of sulfur to be chemically bound in the ash from the gasifier or combustor. This may avoid or reduce the requirements for gas scrubbers which could otherwise be mandatory where a raw coal contains substantial amounts of sulfur.

DISCLOSURE OF INVENTION

In accordance with this invention there is provided a process for treating solid particles of a raw carbonaceous fuel such as coal having an original sulfur content, comprising producing a slurry of a quantity of the raw fuel particles and a liquid medium comprising water, at least one alkali metal compound including a substantial amount of sodium or potassium sulfide or polysulfide or a combination thereof, and a chemical agent comprising calcium or magnesium oxide or carbonate, or dolomite; subjecting the slurry for an effective period of time to elevated temperature and pressure effective with the alkali metal compounds and water to cause the medium to penetrate the microscopic structure of the particles and to chemically and physically incorporate a substantial amount of the chemical agent into the structure; separating the readily separable medium from the fuel particles, and washing the particles to remove most of the alkali metal therefrom while producing a particulate fuel product containing a substantial amount of the chemical agent therein; adding most of the separated medium to the slurry produced as above; adding to the medium or the slurry a sufficient quantity of the chemical agent to replace the chemical agent removed from the slurry with the particulate fuel product; adding more raw particles to the medium or the slurry, and continuing to carry out the foregoing steps with a multiplicity of new additions of the raw fuel particles and with a multiplicity of reuses of the separated medium to produce fuel product particles containing a quantity of sulfur that is not substantially less than the original sulfur content, in addition to the chemical agent.

Typically a multiplicity of new additions of the raw fuel particles and a multiplicity of reuses of the separated medium are carried out while the process is in a substantially steady state. The concentration is sulfur in the medium may remain, or be caused to remain, substantially constant in the steady-state process.

An alkali metal sulfide, or an alkali metal hydroxide, or both may be added to the medium in order to replace the portion of the alkali metal retained in the fuel product particles. The medium may be purged to maintain the process in a steady state with a desired concentration of at least one constituent or combination of constituents in the medium.

The alkali metal compounds in the medium may also comprise hydroxides. The mole percent of the total alkali metal in the medium that is in the sulfide or polysulfide form is typically at least about 15.

Typically oxygen is substantially excluded from the medium to inhibit the formation of sulfites or sulfates therein. To this end, the process may be at least partially carried out in a substantially inert atmosphere which may be enriched with nitrogen.

The ratio of the chemical agent to the coal in the slurry is typically about 0.03 to 0.1 by weight.

The ratio of the sulfide compound to the water is typically about 0.01 to 0.1 by weight. The ratio of water to coal is typically about 1 to 2 by weight.

MODES FOR CARRYING OUT THE INVENTION

Figure 1:
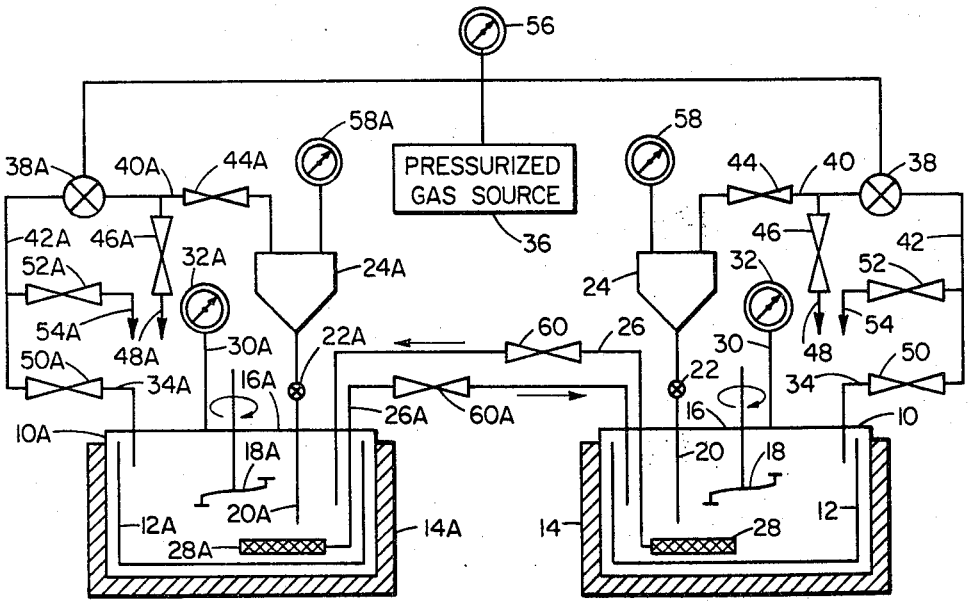
FIG. 1 is a schematic drawing of one form of apparatus for performing the method of the invention, either as a laboratory procedure or as an industrial batch process.

Referring to the right-hand portion of FIG. 1, typical apparatus useful in carrying out the present invention includes a pressure vessel 10, which may be an industrial vessel, a laboratory autoclave, or the like. The vessel 10 has a liner 12 as of stainless steel, capable of withstanding the chemical action of the solutions used therein. The vessel 10 is heated by suitable means, here shown as a furnace 14. The vessel 10 is also equipped with a cover 16, which supports a suitable stirring means 18 such as an electromagnetic stirring mechanism.

A feed pipe 20 extends through the cover 16, and is connected by a ball valve 22 to a charging bomb 24. An outlet pipe 26 also extends through the cover 16, and the lower end of the pipe is connected to a filter 28, which may comprise a stainless steel frit, or sintered disk, located in the bottom of the vessel 10. Also penetrating the cover 16 are connections 30 for a pressure gauge 32, and a purging line 34.

A pressurized gas source 36 is connected to the system through a 3-way valve 38 that allows the pressurized gas supply to be shut off or to be connected to either of the lines 40 or 42. The line 40 is connected through a valve 44 to the charging bomb 24, and also via a valve 46 to a purge line 48. The line 42 is connected via a valve 50 and a line 34 directly into the top of the pressure vessel 10, and is also connected via a valve 52 to a purge line 54.

The gas pressure provided by the source 36, which may be a nitrogen tank, is indicated by a pressure gauge 56, and the pressure in the charging bomb 24 is indicated by a pressure gauge 58. The outlet pipe 26 for the pressure vessel 10 is connected through a valve 60 to a second vessel 10A in the left-hand portion of FIG. 1.

The vessel 10A and its appurtenances are shown in mirror image fashion to be nearly the same as the arrangement described in the right-hand portion of FIG. 1, and corresponding parts bear the same reference numerals, with the letter A added as a suffix to the numerals in the left-hand portion. The outlet pipe 26A for the pressure vessel 10A is connected through a valve 60A to the first vessel 10.

The apparatus of FIG. 1 may be used according to one embodiment of the invention to perform a batch process for treating solid particles of a raw carbonaceous fuel such as coal having an original sulfur content. A typical coal that has been used is Westland coal from the Westland mine in Pennsylvania (Pittsburgh Seam No. 8) having an original sulfur content of about 2 percent.

The coal is typically ground to provide raw fuel particles that are typically of sizes smaller than about 50 U.S. mesh, although they could be larger, say up to 8 mesh or so with appropriate adjustments to other process parameters if necessary. The raw fuel particles typically may then be mixed with a chemical agent comprising calcium or magnesium oxide or carbonate (calcined or uncalcined) or dolomite. Dolomite is a mixture of calcium and magnesium carbonates. It is understood, of course, that the hydroxides of calcium or magnesium are equivalent to the oxides thereof. It is not essential that the chemical agent be mixed with the dry fuel particles, since it can be added separately or added later.

Typically, the raw fuel particles (and typically the catalytic agent also) may be loaded into the pressure vessel 10 either by removing the cover 16 thereof or by charging the vessel by the use of the charging bomb 24. As shown, the charging bomb 24 is preferably hopper shaped in order to channel the particles into the pipe 20 containing the ball valve 22. The ball valve is used to provide an unrestricted conduit for the particles through the pipe 20 into the vessel 10 when the valve is open. The flow of the particles is assisted by pressurizing the charging bomb 24, using the pressure source 36 to apply gas pressure through the valves 38 and 44. The vessel 10 is then typically purged with an inert gas (typically nitrogen) from the pressurized gas source 36 by opening the valves 50 and 52 leading to the purge line 54.

The other vessel 10A is typically loaded with water containing at least one alkali metal compound including a substantial amount of sodium or potassium sulfide or polysulfide or combination thereof. These ingredients can be loaded through the charging bomb 24A, or they can be loaded directly into the vessel 10A when its cover 16A is removed. Since the vessel 10A ordinarily constitutes merely a storage vessel for the liquid medium, the charging bomb 24A and its associated parts are not essential and can be omitted. The vessel 10A is purged with the inert gas so that the liquid medium is sealed thereunder. In this way, oxygen is substantially excluded from the reaction medium to inhibit the formation of sulfites or sulfates therein, by carrying out the process at least partially in a substantially inert atmosphere, such as an atmosphere enriched with nitrogen, for example.

The liquid contained in the vessel 10A is transferred to the vessel 10 through the pipe 26A and the valve 60A. This operation is facilitated by applying pressure to the vessel 10A through the valve 38A and from there either through the valves 44A and 22A or through the valve 50A. With the stirrer 18 in operation, this operation produces in the vessel 10 a slurry of a quantity of the raw fuel particles and a liquid medium comprising water, alkali metal compounds including a substantial amount of sodium or potassium sulfide or polysulfide or a combination thereof and a catalytic agent comprising calcium or magnesium oxide or carbonate, or dolomite. Typically, the liquid medium comprises water, sodium sulfide, and calcium oxide (calcium hydroxide).

By operation of the furnace 14, the slurry is heated, with stirring by the stirrer 18. The slurry is subjected for an effective period of time to elevated temperature and pressure effective with the alkali metal compound and water to cause the medium to penetrate the microscopic structure of the particles and to chemically and physically incorporate a substantial amount of the catalytic agent into the structure. While the parameters of this treatment are more particularly described hereinafter, typically the slurry is exposed for about 10 minutes to a temperature of 225° C. and to the autogenous steam pressure generated in the vessel. The readily separable liquid medium is now separated from the fuel particles by opening the valve 60 and allowing the autogenous steam pressure in the vessel 10 to force the medium through the filter 28 and the pipe 26 into the vessel 10A. While most of the medium is thereby separated from the particles and stored under nitrogen in the second vessel 10A, a small amount of the medium is not readily separable from the particles because the medium adheres to the particles and is trapped by capillary action in the interstices between particles. The particles remaining in the vessel 10 are removed therefrom, either by opening the cover 16 of the vessel or by mixing the particles with water and syphoning or draining the resulting slurry from the vessel. In either case, the particles are washed, say, three times with enough water to equal three times the starting weight of coal. The washing is considered essential in order to remove most of the alkali metal (sodium) from the coal. Thereby there is produced a particulate fuel product containing a substantial amount of the catalytic agent (e.g., calcium), which remains in the fuel particles after the particles have been washed.

A second batch of slurry is now produced as previously described. To this slurry is added most of the separated medium that has been stored in the vessel 10A. To this medium or the slurry is added a sufficient quantity of the catalytic agent to replace the catalytic agent removed from the slurry with the particulate fuel product. More raw fuel particles are added to the medium or the slurry in preparing the new batch. As before, the catalytic agent can be added by mixing it with the raw fuel particles, or the catalytic agent can be added to the medium or to the slurry at an earlier or later time. The new batch of slurry is then mixed and heated in the vessel 10 and the medium is separated and transferred to the vessel 10A as previously described.

In this manner, one continues to carry out the steps in the process with a multiplicity of new additions of the raw particles and with a multiplicity of reuses of the separated medium to produce fuel product particles containing a quantity of sulfur that is not substantially less than the original sulfur content, in addition to the catalytic agent. The fuel product particles, which may be dried if desired and appropriate, constitute highly reactive and encatalyzed feedstocks, and may be used for gasification, combustion, pyrolysis, and/or liquefaction processes.

Figure 2:
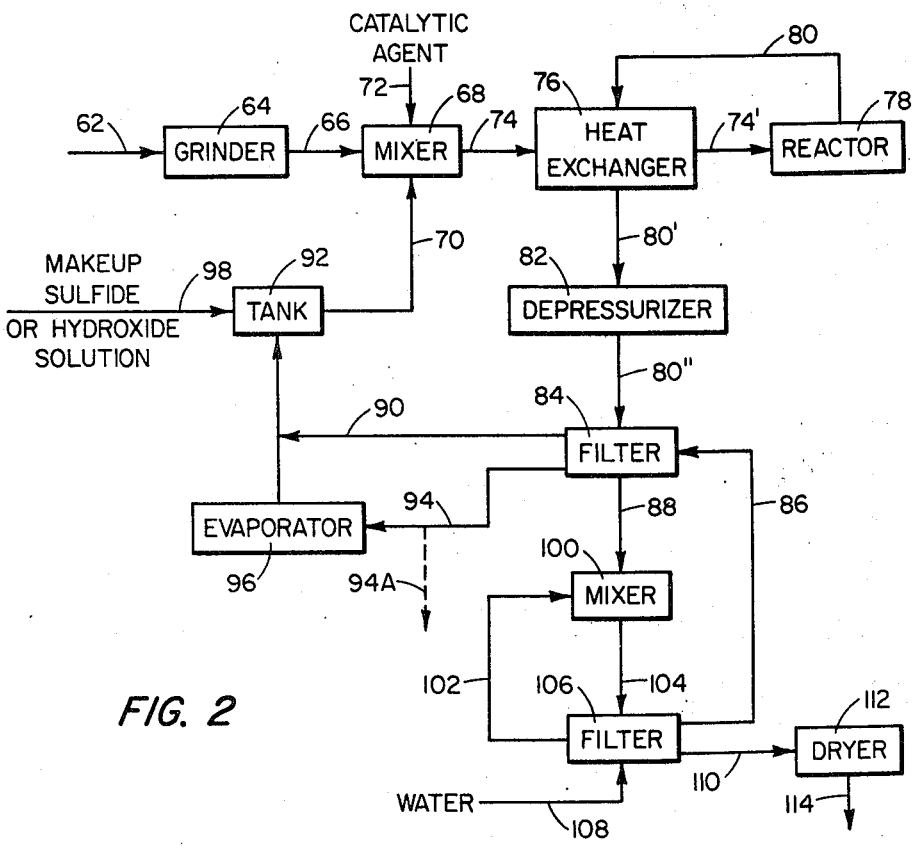
FIG. 2 is a flow diagram illustrating typical apparatus and steps in accordance with the invention for producing feedstocks on a continuous basis.

FIG. 2 is a flow diagram illustrating typical apparatus and steps that may be employed to produce such feedstocks on a continuous basis. According to this diagram, raw coal 62, either washed or untreated, is passed into a grinder 64, which may be any suitable known device for reducing solid matter to a finely divided state. The finely divided coal particles 66 are passed into a mixer 68 and slurried with a liquid medium. The liquid medium comprises water containing at least one alkali metal compound including a substantial amount of sodium or potassium sulfide or polysulfide or a combination thereof fed in through the conduit 70. The liquid medium also comprises a catalytic agent comprising calcium or magnesium oxide or carbonate, or dolomite, which may be fed in at 72. The carbonate or dolomite may be calcined or uncalcined.

A slurry 74 of these ingredients is passed through the heating zone of a heat exchanger 76 to increase its temperature. The heated slurry 74' is then passed into a high-pressure, high-temperature reactor 78 where the slurry is subjected for an effective period of time to elevated temperature and pressure effective with the alkali metal compounds and water to cause the medium to penetrate the microscopic structure of the particles and to chemically and physically incorporate a substantial amount of the catalytic agent into the structure. The resulting slurry 80 of the encatalyzed fuel particles and the liquid medium is then passed through the cooling zone of the heat exchanger 76 to lower its temperature.

From the heat exchanger 76, the cooled slurry stream 80' is passed into a depressurizer 82 and then is passed as a stream 80'' into a filter 84 which separates the readily separable medium from the fuel particles. The encatalyzed coal particles retained in the filter 84 are washed with a stream 86 of process water to remove most of the alkali metal (sodium), and are then discharged from the filter 84 as a stream 88. The separated liquid medium is discharged from the filter 84 as a stream 90 and is fed to a tank 92. A further stream 94 discharged from the filter 84 comprises mostly wash water, also containing most of the small amount of the liquid medium that was not readily separable from the fuel particles in the filter 84. The stream 94 is sent to an evaporator 96 where the water is evaporated and the concentrated medium is fed into the tank 92. Hence, by way of the tank 92 and the conduit 90, most of the separated medium is added to the slurry produced by the mixer 68.

Added to the medium or slurry also, via the line 72, is a sufficient quantity of the catalytic agent to replace the catalytic agent removed from the slurry with the particulate fuel product. To replace the inevitable losses of the alkali metal compounds in the medium, a small amount of makeup hydroxide or sulfide solution is fed into the tank 92 via line 98 as necessary. More raw fuel particles are added, either to the liquid medium in the tank 92 or in the conduit 70, or to the slurry being produced in the mixer 68 (via the line 66).

In the manner described, the apparatus shown in FIG. 2 continues to carry out the steps in the process with a multiplicity of new additions of the raw fuel particles and with a multiplicity of reuses of the separated medium to produce fuel product particles 88 containing a quantity of sulfur that is not less than the original sulfur content, in addition to the catalytic agent.

If desired, for example in order to further lower the sodium or other alkali metal content of the fuel product particles 88, the particles may be reslurried in a mixer 100 with additional water 102. The slurry formed in the mixer 100 is then fed as a stream 104 to a filter 106. The fuel particles retained in the filter 106 are washed with a stream of water 108 and the wash water is discharged as the stream 102. The fuel product particles 110 may then be passed to a dryer 112 if a low moisture feedstock 114 is desired.

As is commonly known, there are wide variations in the characteristics and constituents of solid carbonaceous fuels. Likewise there are differences in the requirements for the fuel product particles depending on the kind of gasifier, combustor, liquefaction plant, or the like in which they are to be used, and in the requirements for its end product. In general it is required that the fuel product particles (feedstock) should be non-caking and non-agglomerating to a certain degree, and the free-swelling index (FSI) should have been reduced to or below some nominal value. For example, some precesses can accept a coal with an FSI of about 2.

In general it is further required that the alkali metal (e.g., sodium) content of the fuel product particles 88 or 110 should be below a certain level. For example, some processes might accept a coal with a sodium level below about 1.2 percent by weight. To meet such a requirement, the treatment process conducted in the liquid medium (in the reactor 78) should yield treated fuel particles as at 80, 80', or 80'' that are in a condition such that they can be said to have a certain degree of "washability" with respect to their content of the alkali metal.

In general it is highly desirable, if not a requirement, that the feedstock (fuel product particles) should also have a significantly higher reactivity than the raw carbonaceous fuel (e.g., coal).

In addition to meeting specific "washability" criteria and specific non-caking, non-swelling, non-agglomerating, and reactive-product criteria, a process according to the invention will ordinarily be required to meet certain economic and ecological criteria. For economic reasons, there is a need to minimize the consumption, and avoid waste, of chemicals and heat energy. Whenever possible, regeneration of the liquid medium is to be avoided. For ecological reasons, any discharge of effluents is to be minimized, or if possible eliminated. Likewise to be minimized or eliminated are storage vessels, ponds, or the like, and effluvia therefrom.

The characteristics of the raw carbonaceous fuel particles and the requirements for the fuel product particles (feedstock) may permit the process of FIG. 2 to be operated in a substantially steady state while a multiplicity of new additions of the raw fuel particles and a multiplicity of reuses of the separated medium are carried out, with substantially all of the separated medium being directly recycled through the tank 92 and the evaporator 96.

Before the steady state is reached, carbonaceous fuels may preferentially remove alkali metal from the medium. If then an alkali metal sulfide such as $Na_2S$ is used in the makeup solution 98, there may be a gradual increase in the concentration of sulfur in the solution while the amount of sulfur in the fuel product particles 88 or 110 remains substantially constant. That is, before the steady state is reached, there may be a gradual decrease in the molar ratio (e.g., Na/S) of alkali metal to sulfur in the medium, and this may be accounted for by formation of polysulfides or higher polysulfides therein. In steady state operation, using sulfide as a makeup solution, the amount of sulfur contained in the fuel product particles may be greater than the original sulfur content of the raw carbonaceous fuel particles. Sulfur buildup in the solution may be minimized by using alkali metal hydroxide (e.g., NaOH) as the makeup solution, although some buildup may still be possible, due, for example, to the dissolution of sulfates that may be present in the original raw carbonaceous fuel.

If certain requirements for the feedstock (fuel product particles) must be met and certain raw carbonaceous fuels must be used in the process, the process may stop "working" satisfactorily before or as the steady state is reached if all of the separated medium is directly recycled through the tank 92 and the evaporator 96. Such a non-working condition may result from the buildup of sulfur in the solution, perhaps in the form of polysulfides, particularly if a sulfide such as $Na_2S$ is used for makeup, or, particularly if a hydroxide such as NaOH is used, from a buildup in the solution of oxidized sulfur species such as sulfites and perhaps sulfates; or a non-working condition might result from some other factor or factors. As previously noted, buildup of sulfur in the medium is less likely if a hydroxide such as NaOH is used for makeup rather than a sulfide such as $Na_2S$. A buildup of oxidized sulfur species could be severe if the starting medium were to contain, for example, the alkali metal predominantly in the form of NaOH rather than in the form of $Na_2S$. However, if the starting medium contains the alkali metal predominantly in the form of $Na_2S$, for example, it is expected that NaOH may be usable as makeup solution without causing a serious problem with the buildup of oxidized sulfur species.

If it is found that a "non-working" situation exists, or if satisfactory operation cannot be achieved, with the process in either the transient or the steady state obtainable by directly recycling all or substantially all of the separated medium, it is still possible to produce a satisfactory feedstock by purging the medium and if necessary suitably regulating the makeup additions of alkali metal compound or compounds thereto. For example, a purge stream path shown by the dashed line at 94*a* may be provided to allow continuous or intermittent purging of the medium. By proper adjustment of the recycle (stream 94) to purge (stream 94*a*) ratio, and if necessary by proper regulation of makeup additions to the medium, the process can still be maintained in a steady state with a desired, constant concentration of at least one constituent (such as sulfur) or combination of constituents (such as Na/S ratio) in the medium.

As previously noted, in a typical process according to the invention oxygen is substantially excluded from the medium to inhibit the formation of sulfites or sulfates therein. It has been found that a sodium sulfite solution, for example, is incapable of rendering the treated coal non-caking, and it is believed that sulfites must be formed before sulfates appear in the medium. Hence the exclusion of oxygen from the medium may avoid the need for purging of the medium, or at least reduce the frequency and/or amount of purging necessary. Depending on the raw carbonaceous material used and the feedstock requirements, the purge, if necessary at all, may involve only a small, "throw-away" quantity of material, or it may be enough to make necessary some form of regeneration of the medium. For example, it may be possible to recover sodium values from the purged solution by controlled oxidation of sodium polysulfide therein, to produce $Na_2S$ and elemental sulfur.

Figure 3:
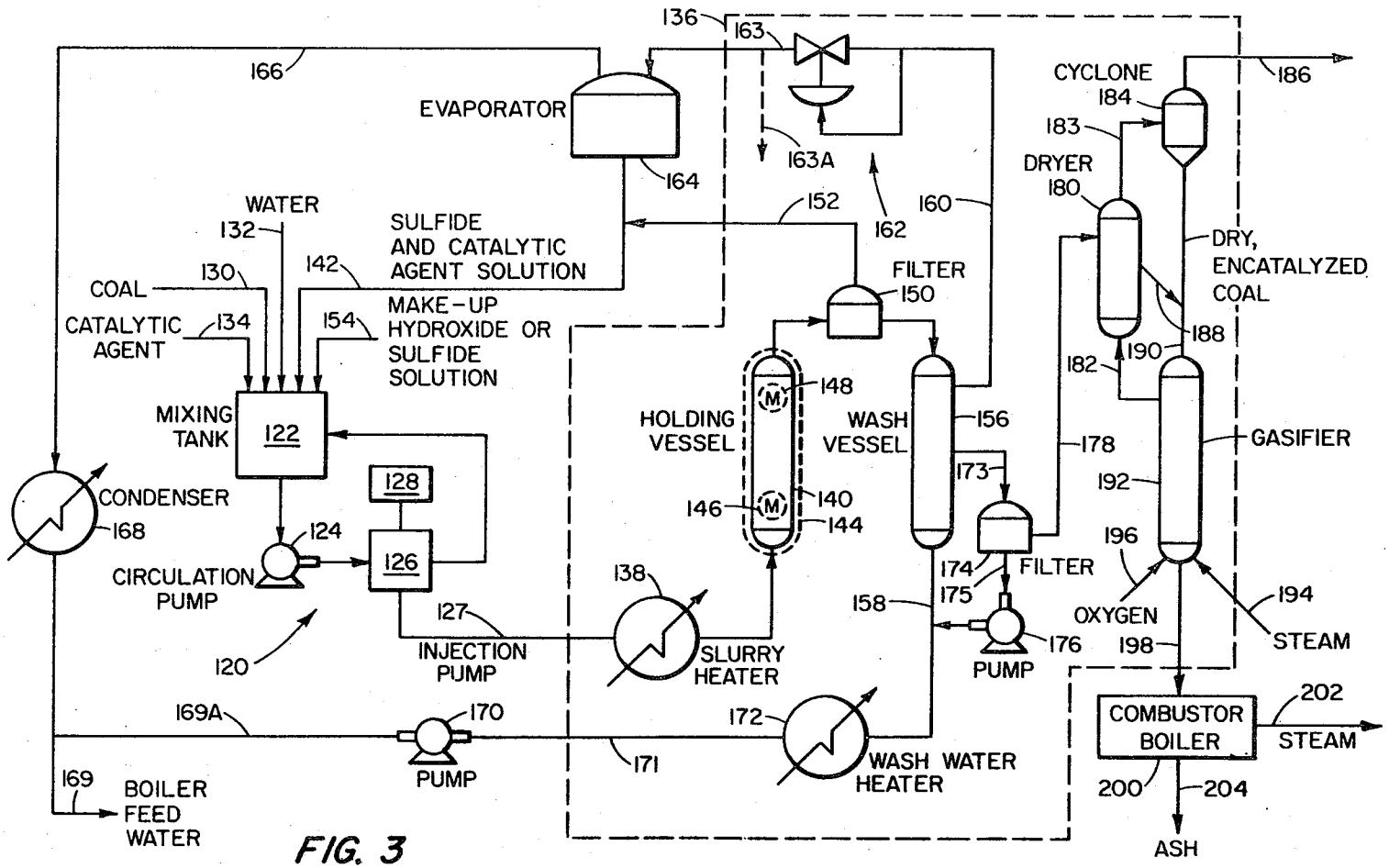
FIG. 3 is a flow diagram showing one way in which a process according to the invention can be incorporated in a high pressure slurry feed system and integrated with a gasifier.

FIG. 3 illustrates one way in which the process of the present invention can be integrated with a high pressure gasifier. As will be noted further hereinafter, the system can also be readily modified for use with a low pressure gasifier system.

Referring to FIG. 3, ground coal is introduced into the process by a conventional slurry-feed system indicated generally at 120 that includes a mixing tank 122, a circulation pump 124, and an injection pump 126 together with its motor-actuator 128. The coal is introduced into the mixing tank 122 typically by a continuous coal-feed system 130, and an approximately equal weight of water per unit time is typically fed in at 132. For each 100 pounds of coal, typically about 5 pounds of a catalytic agent comprising calcium oxide is fed in at 134. The pump 124 maintains a continuous circulation of slurry from the mixing tank 122 through the supply chamber (not shown) of the injection pump 126 and back to the mixing tank 122, thereby maintaining a uniformly-mixed suspension of the coal and the catalytic agent in the water.

The dashed line 136 encloses a number of conventional processing vessels and other apparatus that contain or operate at an elevated pressure, typically in the range of about 200 to 1,000 psig, suitable for gasification of the carbonaceous material. The slurry-feed system 120 is adapted to bring the raw materials from the normal environment at atmospheric pressure into the pressurized system in the region 136. Specifically, the injection pump 126 is used to inject the slurry 127 into a slurry heater 138, and thence into a holding vessel 140, for the slurry produced in the mixing tank 122. The slurry 127 includes a quantity of the raw fuel particles and a liquid medium comprising water, at least one alkali metal compound including a substantial amount of sodium or potassium sulfide or polysulfides or combination thereof fed into the mixing tank 122, and a catalytic agent comprising calcium or magnesium oxide or carbonate, or dolomite, as above described. The slurry 127 is heated in the slurry heater 138, and is subjected in the slurry heater 138 and the holding tank 140 for an effective period of time to elevated temperature and pressure effective with the alkali metal compounds and water to cause the medium to penetrate the microscopic structure of the particles and to chemically and physically incorporate a substantial amount of the catalytic agent into the structure. Typically the slurry is heated to a temperature of about 225° C. As shown by the dotted line 144, the holding vessel 140 may be insulated so that the slurry remains at a fairly constant elevated temperature during its entire passage through the holding vessel 140.

As shown at 146, a mass M of slurry has only recently entered the elevated temperature region. Shown at 148 is a mass M of slurry that has almost passed through and is ready to exit from the holding vessel 140. Typically, the residence time for a mass M in the elevated temperature zone is about 10 minutes, primarily the time required for the mass M to travel through the holding vessel 140 from the position shown at 146 to the position shown at 148. The residence time is determined by the rate of injection and the volume of the holding vessel 140.

Typically, the slurry heater 138 elevates the slurry temperature to a temperature below the thermal degradation temperature for the carbonaceous material. While the thermal degradation temperature can be expected to vary widely with the type of coal used, many Eastern bituminous coals and like coals have a thermal degradation temperature of about 290° to 315° C. At the thermal degradation temperature, the coal starts to soften, appreciable devolatilization occurs, chemical bonds are broken, and cross-occurs to form bigger molecules. Accordingly, the temperature is typically in the range of about 150° to 300° C.

Once the coal particle structure has been thoroughly encatalyzed with calcium ions, for example, in the aqueous solution at temperatures in this range, the coal can be gasified at the much higher gasification temperatures without substantial risk of the objectional swelling, caking, and agglomeration that are ordinarily characteristic of these coals, and the risk of plugging and damage to the gasifier system is minimized. It appears that when the coal has been thoroughly encatalyzed with calcium by the treatment in the aqueous medium, it can be gasified with either steam or hydrogen without the usual difficulties. Apparently the catalytic action occurs because the calcium prevents undesired reactions such as cross-linking reactions that otherwise result in the formation of larger, more unreactive molecules.

From the holding vessel 140, the slurry passes to a filter 150 which separates the readily separable liquid medium from the fuel particles and returns the medium via a line 152 and the line 142 to the mixing tank 122, whereby a substantial portion of the separated medium is added to the slurry produced in the mixing tank 122. To replace minor losses of the alkali metal (sulfide) compounds, a small amount of makeup alkali metal (hydroxide or sulfide) solution may be added through a line 154.

The fuel particles separated from the liquid medium in the filter 150 are injected into a wash vessel 156. In the wash vessel 156, the injected particles move downwardly by gravity through an upflow of hot wash water injected through a pipe 158 into the wash zone contained in the vessel 156. The water that is passed over the encatalyzed particles in the wash vessel 156 removes most of the alkali metal compounds from the particles while allowing a substantial portion of the catalytic agent (calcium) to remain in the particles.

Most of the wash water passes out of the vessel 156 through a pipe 160 and thence through a pressure or flow regulating valve 162 and a pipe 163 out of the pressurized region 136 and into an evaporator 164. To allow purging of the system, if necessary, a branch 163A of the pipe 163 may be provided in the manner and for the reasons previously described for the streams 94 and 94A in FIG. 2. In evaporator 164, the solution containing the alkali metal compounds and also some of the catalytic agent is reconcentrated and fed back through the line 142 into the mixing tank 122. The excess water that has diluted the solution during the washing step is evaporated and fed via a pipe 166 to a condenser 168 wherein it is condensed. The water flowing out of the condenser 168 to a pipe 169 is used as boiler feed water or the like. A portion of the condensed water is pumped through a branch pipe 169A, a pump 170, and a pipe 171 back into the pressurized system 136 and is heated by a wash water heater 172. The heater 172 may be supplied with steam or it may be connected in heat-exchange relationship with the condenser 168 in a conventional way.

The fuel particles that have been washed in the wash vessel 156 are separated from the wash water with the aid of a filter 174 (fed by a line 173) and a pump 176 (fed by a line 175) which returns the filtrate back into the hot water injection line 158. The resulting particulate fuel product 178 containing the incorporated catalytic agent is transferred into a dryer 180. The dryer 180 may comprise a conventional fluidized bed. In the dryer 180, the fuel product particles are injected into an upflowing stream of hot raw gas fed via a line 182 from a gasifier 192 that is more completely described hereinafter. The raw gas 182 is passed over the particles in the dryer 180 and thence into a cyclone 184 that separates any remaining particles (which may have been entrained in the gaseous product stream 183) from the gas stream exiting from the cyclone 184 via a conduit 186. The bulk of the dried particles, however, are withdrawn from the dryer 180 via a line 188. The particles separated from the gas stream in the cyclone 184 are combined with the other dried particles exiting from the dryer on the line 188 to form a stream of dry, encatalyzed fuel product particles that fall by gravity through a line 190 into a gasifier vessel 192.

In the gasifier 192, the fuel product particles are gasified by the conventional reaction of the particles with steam admitted through a line 194. Conventionally also, oxygen is supplied to the gasifier 192 via a line 196 in order to burn enough of the carbon contained in the fuel particles to supply the heat necessary for the endothermic reaction between the steam and the remaining particles. The char from the gasifier 192 is delivered via a path 198 to a combustor and boiler unit 200 for generating steam. The steam is delivered via a line 202 and it may be used to feed the gasifier 192, and to provide heat for the slurry heater 138 and the wash water heater 172.

As previously explained, the catalytic agent used comprises calcium or magnesium oxide or carbonate or a mixture thereof (e.g., calcined or uncalcined dolomite). As used herein, the term "oxide" includes the hydroxide. As is well known, the addition of calcium oxide, for example, to water, in forming the slurry, results in the formation of calcium hydroxide and the latter compound can be added per se in forming the slurry in the mixing tank 122 if desired. In addition to acting as an effective gasification catalyst, calcium or magnesium is an absorber of sulfur that is contained in the coal. While a relatively small amount of hydrogen sulfide may be contained in the raw gaseous product of the gasifier 192, a considerable amount of sulfur is captured in the char, appearing in the form of calcium or magnesium sulfide or a combination thereof. The combustor 200 may be operated according to known methods in such a way that the calcium or magnesium sulfide and other sulfur in the char is converted during combustion into calcium or magnesium sulfate that can be disposed of with the ash removed via a line 204 to an ash disposal system without producing severe environmental problems.

While FIG. 3 specifically illustrates a process according to the invention for supplying particulate fuel product particle feedstocks directly into a high-pressure gasifier system, it is apparent that a similar adaptation of the process can be used to supply the feedstock to a low-pressure gasifier system. To this end, the fuel product particles 178 from the filter 174, for example, could be sent to a suitable flash vessel (mixed with a small amount of water if necessary) and flashed to drive off the water and drop the pressure before sending the particles directly to a low-pressure gasifier.

Experiments were performed using laboratory autoclaves in an arrangement similar to that shown in FIG. 1. The materials used were Westland coal ground to −50 US mesh, calcium oxide, sodium sulfide, and water, using the treatment conditions shown in footnote (a) on Table 1. Insofar as possible, the experiments were carried out with the medium under a nitrogen atmosphere. The maximum pressure achieved at the 225° C. temperature was 400 psi. After treatment in the liquid medium, the coal particles were washed three times employing a wash water to dry coal ratio of 2. The washed, encatalyzed coal was dried in a vacuum oven under nitrogen. With each new batch of coal, there was added sufficient calcium oxide, and sufficient sodium sulfide to replenish the sodium in the solution, based on the weight of the fuel product obtained in the autoclave 10 in the previous experiment.

The liquid medium was reused four times, as indicated by the numbered experiments 2,3,4, and 5.

250 psig and 850° C. During the steam gasification, all samples were found to be nonagglomerating.

Figure 4:
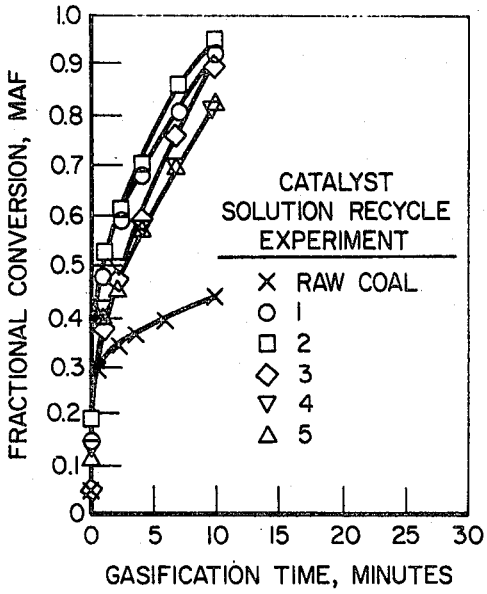
FIG. 4 is a graph showing the effect of multiple reuses of a liquid treating medium on the behavior of treated coal undergoing steam gasification.

The MAF (Moisture and Ash-Free) fractional conversion versus time data for the gasification experiments are plotted in FIG. 4.

The curves particularly for experiments four and five appear to indicate that there is a decline in the reactivity with progressive reuses of the separated $Na_2S$ medium. However, even after four recycles the treatment produced a feedstock that was much more reactive than raw coal.

The difference between the reactivity of the treated and raw coals is more dramatic than may appear from FIG. 4 since about 30% MAF conversion is achieved almost instanteously for raw coal as well as treated coal. The initial rapid conversion is to a large extent accounted for by the gasification of volatile matter. The remainder, after the volatiles have been gasified, is called fixed carbon. The rate of gasification of the fixed carbon can be defined as $$k = \frac{-dX/dt}{(1-X)}\ ;\ X > X_{VM}$$

where X is the MAF conversion at any time, t, and $X_{VM}$ is the MAF conversion corresponding to the volatile matter. The values of k shown in Table 1 were determined for the interval between five and eleven minutes during gasification. The treated coals have k values that are eight to fifteen times that for raw coal, thus demonstrating that the treatment substantially increases the steam gasification reactivity. The k values appear to decrease, though not smoothly, with an increase in the number of reuses of the medium.

The Na/S molar ratio in the solution may affect both the gasification properties and the sodium content of the

TABLE 1

DATA FOR BATCHES OF COAL TREATED IN FIVE LEACHANT RECYCLE EXPERIMENTS FOR THE $Na_2S$/CaO TREATMENT[a] SYSTEM

| | Analyses, wt % of Coal | | | | Spent Solution Composition[b] | | | Gasification Properties | | |
|---|---|---|---|---|---|---|---|---|---|---|
| Sample | Ash (dry) | Total S (MAF) | Na (MAF) | Ca (MAF) | Na (g/l) | Sulfide (g/l) | Na/S (Molar ratio) | Coal FSI | Steam Gasification Rate, k (min⁻) | Tendency for Agglomeration During Gasification |
| Raw coal | 12.4 | 1.97 | 0.03 | 0.10 | — | — | — | 7.5 | 0.0202 | Severe |
| Experiment 1 | 22.0 | 2.19 | 1.10 | 8.40 | 23.9 | 19.2 | 1.70 | NA[c] | 0.310 | None |
| Experiment 2 | 22.1 | 1.93 | 1.08 | 7.38 | 26.6 | 22.6 | 1.62 | NA | 0.322 | None |
| Experiment 3 | 23.5 | 2.02 | 1.15 | 8.26 | 23.0 | 21.6 | 1.49 | NA | 0.269 | None |
| Experiment 4 | 20.2 | 1.98 | 0.86 | 7.82 | 27.5 | 27.7 | 1.38 | NA | 0.161 | None |
| Experiment 5 | 19.1 | 1.86 | 0.99 | 6.55 | 27.0 | 30.4 | 1.24 | NA | 0.172 | None |

[a]Treatment conditions: Westland coal; CaO/coal = 0.1; $Na_2S$/coal = 0.2; water/coal = 4.0; temperature = 225 C. time = 20 minutes (excluding heat up time).
[b]The starting solution for Experiment 1 had a Na/S molar ratio of 2, a sulfur concentration of 20.5 g/l and sodium concentration of 29.5 g/l.
[c]NA Stands for an FSI value of unity and a nonagglomerating nature of coal.

As indicated by the analysis of the coal, the coal picked up about one percent of the sodium, while the sulfur content of the coal remained virtually unchanged. The Na/S molar ratio decreased from 2 to 1.24 after four recycles. The sulfur content of the solution probably increased because of additions of $Na_2S$ that were used to replenish the sodium picked up by the coal. The sodium content appeared to be declining somewhat with increasing reuses of the medium. The free-swelling index (FSI) values of all treated samples were unity as opposed to 7.5 for the untreated coal. The treated samples were steam gasified in a thermobalance reactor at treated coal. It can be shown on the basis of sodium and sulfur balances that the amount of makeup sodium to be introduced into the system as $Na_2S$ is $$X = \frac{a}{(1 - B/2)}$$

where X represents the makeup sodium as a percentage by weight of the coal as received, a represents the weight percentage of sodium pickup by the coal and B represents a required Na/S molar ratio for the solution in the steady state. It is believed that values of a and B of 0.5 and 1.0 respectively can be achieved while still producing a non-agglomerating and fairly reactive feedstock, and the value of X will then be 1.0 percent.

Experiments were also performed to determine the useful treatment conditions for the $Na_2S/CaO$ system. All of these experiments were performed using fresh sodium sulfide solution. As shown in Table 2, a dramatic change in the gasification properties takes place at a temperature between 150° and 225° C. The FSI of samples treated at 150° C. was higher than the FSI of coals treated at lower temperatures because the latter samples were exposed to air during treatment and this may have caused preoxidation of the coal. It appears that a minimum treatment temperature of about 150° C. (perhaps 175° C.) is necessary to produce a coal with an FSI value of 2, which may be acceptable for some gasification processes.

TABLE 2

EFFECT OF TREATMENT TEMPERATURE ON THE PROPERTIES OF COAL FOR THE $Na_2S/CaO$ SYSTEM

| Sample Number 3229- | Treatment[a] Temperature, C. | Time, min | Na, wt % MAF | FSI | Steam Gasification Rate, $min^{-1}$ |
|---|---|---|---|---|---|
| Raw coal | — | — | 0.03 | 7.5 | 0.0202 |
| 47-25 | 25 | 30 | 0.76 | 2[b] | ND[c] |
| 63-21 | 25 | 180 | ND[c] | 2½[b] | 0.0511 |
| 70-28 | 95 | 20 | ND[c] | 2½[b] | 0.0649 |
| 53-23A2 | 150 | 20 | 0.18 | 3 | 0.0672 |
| 51-21A2 | 225 | 10 | 0.61 | NA[d] | 0.259 |

[a]Treatment conditions: Westland coal; CaO/coal = 0.1; $Na_2S$/coal = 0.2; water/coal = 4.0.
[b]The FSI would have been higher had the sample not been exposed to air during treatment.
[c]ND = Not determined.
[d]NA = Nonagglomerating (FSI = 1).

The treatment temperature is expected to be less than 325° C. where coal will probably begin to soften. The present data at 225° C. and previous data (not shown) at 250° C. indicate that no improvement in gasification reactivity occurs at temperatures greater than 225° C. Generally, temperatures higher than 275° C. are undesirable because of the very high pressures required to maintain the medium in the aqueous phase. Hence, typical temperatures will be between about 175° C. and 300° C. and selected on the basis of other process considerations such as gasification pressure.

The treatment time was varied from one to sixty minutes at a temperature of 225° C. As shown in Table 3, a treatment time of 1 minute results in lowering the FSI value from 7.5 to 1 and increasing steam gasification reactivity by a factor of 3.5.

TABLE 3

EFFECT OF THE TREATMENT TIME ON THE PROPERTIES OF COAL FOR THE $Na_2S/CaO$ SYSTEM

| Sample Number 32294- | Treatment[a] Time, min | Na, wt % MAF | FSI | Steam Gasification Rate, $min^{-1}$ |
|---|---|---|---|---|
| Raw coal | — | 0.03 | 7.5 | 0.0202 |
| 71-23 | 1 | 0.30 | 1 | 0.071 |
| 51-20A1 | 2 | 0.36 | NA[b] | 0.138 |
| 51-21A2 | 10 | 0.61 | NA | 0.259 |
| 51-22C | 60 | 0.90 | NA | 0.205 |

[a]Treatment conditions: Westland coal; CaO/coal = 0.1; $Na_2S$/coal = 0.2; water/coal = 4.0.
[b]Nonagglomerating (FSI = 1).

Figure 5:
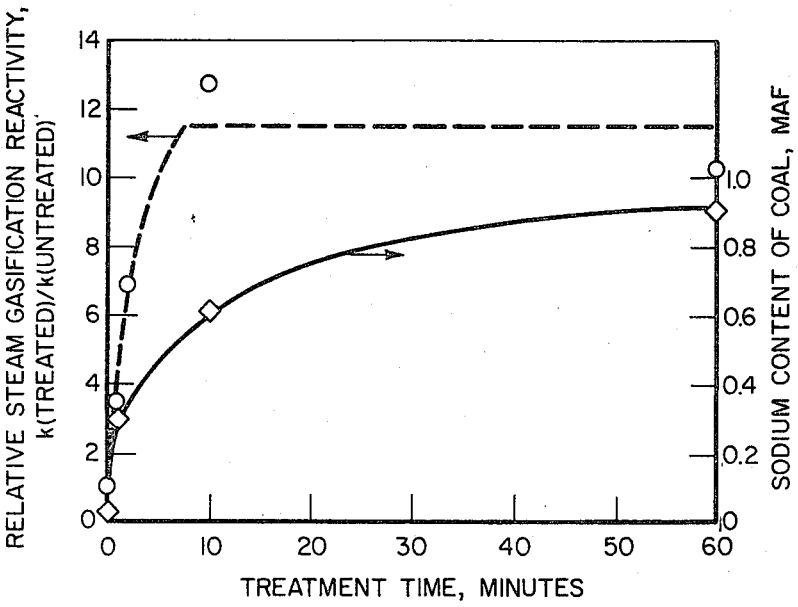
FIG. 5 is a graph showing the effect of treatment time on the relative steam gasification reactivity and sodium content of treated coal.

Between two and ten minutes, the reactivity and the sodium content increase as shown in FIG. 5 while the FSI remains at unity. The data suggests that a treatment time longer than ten minutes does not result in a significant increase in reactivity but does cause the sodium content to increase significantly, which is understandable. Thus, treatment times longer than ten minutes are not desirable at 225° C. However a larger residence time may be desirable at a lower temperature, or if coarser coal is being used or if the process were to be carried out under the conditions that exist, for example, in a pipeline.

The results of treatment for one minute indicate that in less than one minute the FSI can be lowered to a value of about one and one half to two, and this is sufficiently low to permit handling of the coal in several gasification processes. Furthermore, the ability to handle caking coals may be of more serious concern than the low reactivity of raw coal. Thus, the treatment time range may cover times as small as one half minute, perhaps, or may include times as long as an hour or more.

TABLE 4

EFFECT OF CaO/COAL RATIO ON THE PROPERTIES OF COAL FOR THE $Na_2S/CaO$ SYSTEM

| Sample Number 32294- | Treatment[a] CaO/coal | Time, min | Na, wt % as rec'd coal | FSI | Steam Gasification Rate, $min^{-1}$ |
|---|---|---|---|---|---|
| Raw coal | | | 0 | 7.5 | 0.0202 |
| 59-24A2 | 0.05 | 20 | 1.54 | NA | 0.186 |
| 51-21A2 | 0.1 | 10 | 0.61 | NA | 0.259 |

[a]Treatment conditions: Westland coal; $Na_2S/CaO$ = 0.2; water/coal = 4.0; temperature = 225 C.

Two levels of calcium oxide to coal ratio were tried with the results shown in Table 4, and provide a basis for comparison with earlier work performed on the sodium hydroxide and calcium oxide system described in U.S. Pat. No. 4,092,125, Stambaugh, et al. Both samples were non-agglomerating and very reactive compared to raw coal. There appeared to be a significant increase in the reactivity and a substantial reduction in the sodium content from 1.54 to 0.61 percent MAF on doubling the amount of CaO, which would appear to be cost effective on the basis of reduced sodium losses alone.

Based on earlier work with the NaOH/CaO system, it would appear that a CaO to coal ratio of about 0.03 is the minimum necessary to produce a non-agglomerating coal, and a ratio greater than about 0.10 does not provide sufficient improvement in reactivity or sodium content reduction to warrant the use of additional CaO. One reason for using a higher ratio, perhaps up to about 0.3, might be to increase the percentage of sulfur captured by calcium during gasification or combustion. Lower ratios down to perhaps about 0.01 might be found useful for certain purposes.

Figure 6:
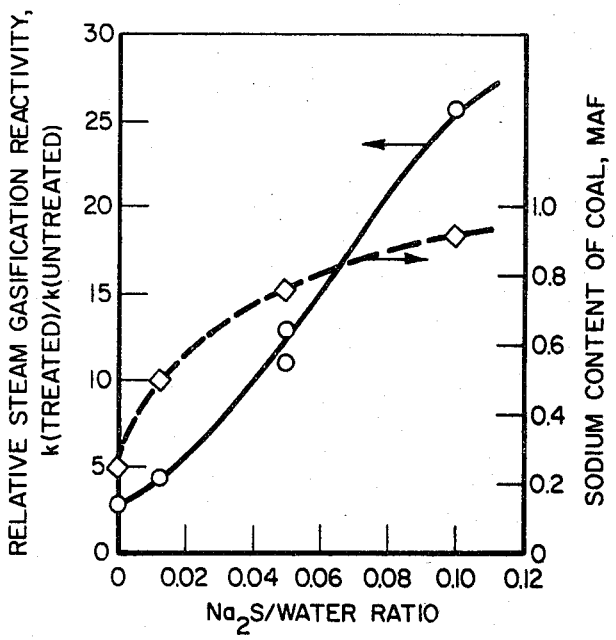
FIG. 6 is a graph showing the effect of the sodium sulfide-to-water ratio on the steam gasification reactivity and sodium content of treated coal.

A limited number of experiments were done to determine the effect of water to coal, $Na_2S$ to coal, and $Na_2S$ to water ratios, only two of which are independent variables. The results, summarized in Table 5, suggest that the $Na_2S$ to water ratio is probably the key variable relative to water to coal and $Na_2S$ to coal ratios. Increasing the $Na_2S$ to water ratio results in an increase in the reactivity and the sodium content as shown in FIG. 6 but a decrease in FSI value of coal. The FSI value drops to unity as the $Na_2S$ to water ratio increases to a value of about 0.05. On doubling the $Na_2S$ to water ratio to 0.1, the reactivity doubles but the sodium content increases significantly making the cost effectiveness of increasing the $Na_2S$ to water ratio questionable. The typical range for $Na_2S$ to water ratio appears to be from about 0.01 to 0.1, the lower limit being applicable particularly to those processes that can accept a coal with an FSI value of 2. However, for certain purposes higher or lower ratios in the range of about 0.001 to 0.4 may be found useful.

TABLE 5

EFFECT OF $Na_2S$ CONCENTRATION ON PROPERTIES FOR THE $Na_2S$/CaO SYSTEM

| Sample Number 32294- | Treatment[a] Water/coal | $Na_2S$/coal | $Na_2S$/water | Time, min | Na, wt % MAF | FSI | Steam Gasification Rate, $min^{-1}$ |
|---|---|---|---|---|---|---|---|
| Raw coal | — | — | — | — | 0.03 | 7.5 | 0.0202 |
| 61-23 | 4.0 | 0 | 0 | 20 | ND[b] | 4 | 0.0565 |
| 73-23 | 4.0 | 0.05 | 0.0125 | 20 | 0.50 | 2 | 0.0859 |
| 57-23$A_2$ | 2.0 | 0.1 | 0.05 | 20 | 0.76 | NA[c] | 0.222 |
| 51-21$A_2$ | 4.0 | 0.2 | 0.05 | 10 | 0.61 | NA | 0.259 |
| 55-23$A_2$ | 2.0 | 0.2 | 0.1 20 | 0.92 | NA | 0.520 | |

[a]Temperature = 225 C.; CaO/coal = 0.1.
[b]ND = Not determined.
[c]NA = Nonagglomerating (FSI = 1).

Several additional comments need to be made here. First, doubling the water to coal ratio while keeping the $Na_2S$ to water ratio constant at 0.05 does not appreciably affect the properties of coal (compare sample 57-23$A_2$ with sample 51-21$A_2$). Second, when only CaO is used the FSI value is reduced to 4 only and the reactivity is increased only moderately. (Other studies have shown that a treatment temperature of 225° C. is too low for the CaO system to allow the FSI to be reduced to an acceptable level, e.g., 2.) And third, the desirable water to coal ratio is probably the minimum required to produce a pumpable slurry, i.e., about 1.5, to limit the size of the processing equipment. Water to coal ratios in the range of about 1–10 may be found useful for various purposes.

In order to study the relationship of the process of this application to the process of U.S. Pat. No. 4,092,125, Stambaugh and Chauhan, four treatment experiments were performed using mixtures of $Na_2S$, NaOH, and CaO. The treated coals were evaluated as to their sodium content and as to their steam gasification and hydrogasification reactivity. A summary of the results is given in Table 6.

The sodium analysis data show that changing the composition of the solution from 100 percent NaOH to 100 percent $Na_2S$ does not affect the sodium content of treated coal. It should be pointed out that in drawing this conclusion the data for sample 51-21$A_2$ was disregarded because it was produced via a quick-heating and quick-quenching technique as opposed to the slow-heating and slow-cooling technique used for all other samples.

Figure 7:
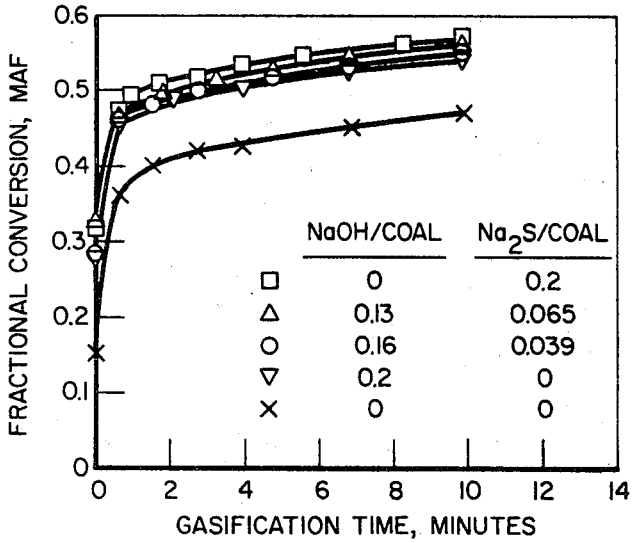
FIG. 7 is a graph showing the effect of various treatment mixtures of sodium sulfide and sodium hydroxide on the behavior of treated coal undergoing hydrogasification.

The hydrogasification runs were carried out at 850° C. and 500 psig. All treated samples were found to be non-agglomerating and about equally reactive as shown by the values for specific rate which is defined for the regime where no more of the highly reactive carbon is present (i.e., after 2 minutes of reaction time). A comparison with raw coal shows that the treated coal contains about 8 percent more of the highly reactive carbon than raw coal (see FIG. 7). Also, the rate of gasification of the relatively unreactive carbon for the treated coal is about 60 to 80 percent higher than for raw coal as shown in Table 6 and FIG. 8.

TABLE 6

DATA ON TREATMENT OF CAOL WITH NaOH + $Na_2S$ + CaO

| Sample Number 32294 | $Na_2S$/Coal | NaOH/Coal | Time, min | Na, Wt % (MAF) | Hydrogasification[b] Rate, $min^{-1}$ | Gasification[c] Rate, $min^{-1}$ |
|---|---|---|---|---|---|---|
| Raw coal | | | | 0.03 | 0.0115 | 0.0202 |
| 75-20 | 0.0 | 0.2 | 30 | 1.21 | 0.0179 | 0.648 |
| 76-20 | 0.039 | 0.16 | 30 | 1.19 | 0.0180 | 0.238 |
| 77-21 | 0.065 | 0.13 | 30 | 1.35 | 0.0207 | 0.252 |
| 42-30 | 0.2 | 0.0 | 20 | 1.10 | ND[e] | 0.310 |
| 51-21$A_2$ | 0.2 | 0.0 | 10[d] | 0.61 | 0.0203 | 0.259 |

[a]Westland coal; CaO/coal = 0.1; $H_2O$/coal = 4; temperature = 225 C.
[b]At 850 C., 500 psig.
[c]At 850 C., 250 psig.
[d]In all experiments but this one, slow heating and cooling of samples was employed, the result being that the effective treatment time was much longer than 20 to 30 minutes indicated for other experiments.
[e]ND = Not determined.

The results regarding the treatment with NaOH+CaO (sample No. 75-20) appear to be consistent with previous results which indicated that the treatment of Montour No. 4 mine coal improved the hydrogasification reactivity drastically only when the NaOH/water ratio was more than 0.05. Thus, the sodium levels were too low in this study to see any large effects on reactivity.

Figure 8:
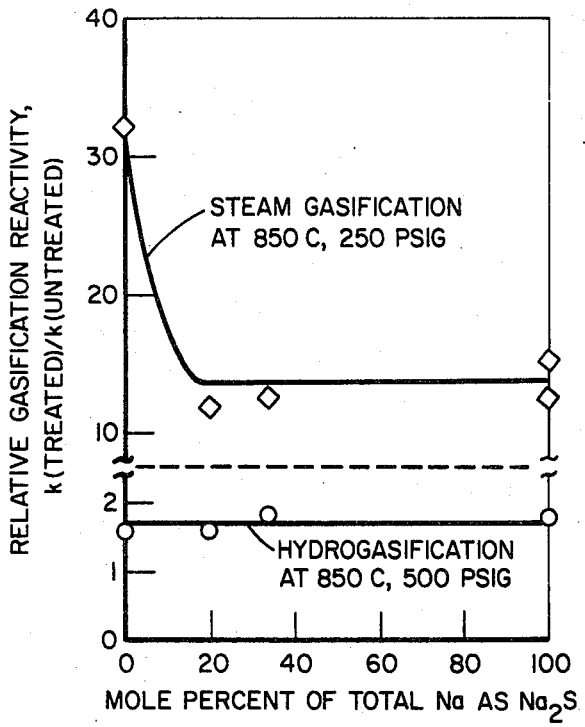
FIG. 8 is a graph showing the rates (relative to untreated Westland coal) of steam gasification and hydrogasification of Westland coal treated with mixtures of sodium hydroxide and sodium sulfide as a function of the mole percent of the total sodium in the reagent that is present as sodium sulfide.

The steam gasification reactivity data show that the coal treated with NaOH+CaO is about 2.5 times as reactive as coals treated with catalyst solutions containing 20 percent or more sodium present as $Na_2S$ (see FIG. 8). However, this high reactivity can not be maintained for more than one or two recycles of the medium without expensive regeneration of the sodium hydroxide solution.

From the foregoing, it is apparent that it is within the purview of the present invention to use a medium containing mixtures of alkali metal hydroxides along with the sulfides in the solution. In this case, some oxidized sulfur species may be present in the solution. It is not certain at present whether there will be a continuous buildup of these oxidized species, or the extent to which purging of the solution may be necessary to maintain the effectiveness of the process.

While the invention has been shown and described as being embodied in certain specific procedures and apparatus, such showing and description are meant to be illustrative only and not restrictive, since obviously many changes and modifications can be made within the spirit and scope of the invention.

In the drawings and in portions of the specification, the chemical agent recited in the claims (calcium or magnesium oxide or carbonate, or dolomite) is referred to as a catalytic agent, since it has a catalytic effect on processes that utilize the fuel product particles made by the process of the present invention, as herein explained and exemplified.

We claim:

1. A process for treating solid particles of a raw carbonaceous fuel of the coal or coke type having an original sulfur content, comprising (a) producing a slurry of a quantity of the raw fuel particles and a liquid medium comprising water, at least one alkali metal compound including a substantial amount of sodium or potassium sulfide or polysulfide or a combination thereof, and a chemical agent comprising calcium or magnesium oxide or carbonate, or dolomite, (b) subjecting the slurry for an effective period of time to elevated temperature and pressure effective with the alkali metal compounds and water to cause the medium to penetrate the microscopic structure of the particles and to chemically and physically incorporate a substantial amount of the chemical agent into the structure, (c) separating the readily separable medium from the fuel particles and washing the particles to remove most of the alkali metal therefrom while producing a particulate fuel product containing a substantial amount of the chemical agent therein, (d) adding most of the separated medium to the slurry produced in step (a), (e) adding to the medium or the slurry a sufficient quantity of the chemical agent to replace the chemical agent removed from the slurry with the particulate fuel product, (f) adding more raw fuel particles to the medium or the slurry, and (g) continuing to carry out steps (b-f) with a multiplicity of new additions of the raw fuel particles and with a multiplicity of reuses of the separated medium to produce fuel product particles containing a quantity of sulfur that is not substantially less than the original sulfur content, in addition to the chemical agent.

2. A process as in claim 1, wherein a multiplicity of new additions of the raw fuel particles and a multiplicity of reuses of the separated medium are carried out while the process is in a substantially steady state.

3. A process as in claim 2, wherein the concentration of sulfur in the medium remains substantially constant in the steady state process.

4. A process as in claim 1, wherein an alkali metal sulfide is added to the medium in order to replace the portion of the alkali metal retained in the fuel product particles.

5. A process as in claim 1, wherein an alkali metal hydroxide is added to the medium in order to replace the portion of the alkali metal retained in the fuel product particles.

6. A process as in claim 3, 4, or 5, wherein the medium is purged to maintain the process in a steady state with a desired concentration of at least one constituent or combination of constituents in the medium.

7. A process as in claim 1, wherein the alkali metal compounds also comprise hydroxides.

8. A process as in claim 7, wherein the mole percent of the total alkali metal in the medium that is in the sulfide or polysulfide form is at least about 15.

9. A process as in claim 1, wherein oxygen is substantially excluded from the medium to inhibit the formation of sulfites or sulfates therein.

10. A process as in claim 9, wherein the process is at least partially carried out in a substantially inert atmosphere.

11. A process as in claim 10, wherein the atmosphere is enriched with nitrogen.

12. A process as in claim 1, wherein the ratio of the chemical agent to the coal in the slurry is about 0.03 to 0.10 by weight.

13. A process as in claim 1, wherein the ratio of the sulfide compound to water is about 0.01 to 0.1 by weight.

14. A process as in claim 13, wherein the ratio of water to coal is about 1 to 2 by weight.

15. A process as in claim 14, wherein the ratio of the chemical agent to the coal is about 0.03 to 0.10 by weight.

* * * * *

UNITED STATES PATENT OFFICE

CERTIFICATE OF CORRECTION

PATENT NO. : 4,280,817 Page 1 of 2

DATED : July 28, 1981

INVENTOR(S) : Satya P. Chauhan; Herman F. Feldmann; Edgel P. Stambaugh and Ke-Tien Liu It is certified that error appears in the above-identified patent and that said Letters Patent are hereby corrected as shown below:

Column 3, line 66, "is" should read -- of -- .

Column 8, line 41, "precesses" should read -- processes -- .

Column 13, Table 1, "(min $^{-}$)" should read -- (min $^{-1}$) -- .

Column 13, Table 1, "and sodium" should read -- and a sodium --.

Column 14, line 15, "instanteously" should read -- instantaneously -- .

Column 15, Table 2, "3229-" should read -- 32294- -- .

Column 15, Table 2, 3rd entry under FSI heading, "2½(b)" should read -- 2-½(b) -- .

Column 15, Table 2, 4th entry under FSI heading, "2½(b)" should read -- 2-½(b) -- .

Column 15, Table 3, "EFFECT OF THE TREATMENT" should read -- EFFECT OF TREATMENT -- .

Column 15, Table 3, "(b)Nonagglomerating" should read -- (b)NA = Nonagglomerating -- .

UNITED STATES PATENT OFFICE

CERTIFICATE OF CORRECTION

PATENT NO. : 4,280,817

DATED : July 28, 1981

INVENTOR(S) : Satya P. Chauhan; Herman F. Feldmann; Edgel P. Stambaugh and Ke-Tien Liu It is certified that error appears in the above-identified patent and that said Letters Patent are hereby corrected as shown below:

Column 17, Table 5,

| | | | | | | | |
|---|---|---|---|---|---|---|---|
| "55-23A$_2$ | 2.0 | 0.2 | 0.1 | 20 | 0.92 | NA | 0.520" |

Should read

| | | | | | | | |
|---|---|---|---|---|---|---|---|
| -- 55-23A$_2$ | 2.0 | 0.2 | 0.1 | 20 | 0.92 | NA | 0.520-- |

Column 18, Table 6, "CAOL" should read -- COAL -- .

Column 18, Table 6, the heading "Gasification$^{(c)}$ Rate, min$^{-1}$"

should read

-- Steam Gasification$^{(c)}$ Rate, min$^{-1}$ -- .

Signed and Sealed this

First Day of December 1981

[SEAL]

Attest:

GERALD J. MOSSINGHOFF

Attesting Officer

Commissioner of Patents and Trademarks